US010021949B2

(12) United States Patent
Cooper

(10) Patent No.: US 10,021,949 B2
(45) Date of Patent: Jul. 17, 2018

(54) COLLAPSIBLE TRAVEL NECK SUPPORT TUBE

(71) Applicant: Donna Cooper, Jacksonville, FL (US)

(72) Inventor: Donna Cooper, Jacksonville, FL (US)

( * ) Notice: Subject to any disclaimer, the term of this patent is extended or adjusted under 35 U.S.C. 154(b) by 0 days.

(21) Appl. No.: 14/926,236

(22) Filed: Oct. 29, 2015

(65) Prior Publication Data

US 2016/0045008 A1 Feb. 18, 2016

Related U.S. Application Data

(63) Continuation-in-part of application No. 12/510,256, filed on Jul. 27, 2009, now abandoned.

(51) Int. Cl.

| | |
|---|---|
| ***A47C 7/38*** | (2006.01) |
| ***A45C 13/30*** | (2006.01) |
| ***A45F 3/02*** | (2006.01) |
| ***A45F 3/14*** | (2006.01) |

(52) U.S. Cl.

CPC ..... *A45C 13/30* (2013.01); *A45F 3/02* (2013.01); *A45F 3/14* (2013.01); *A47C 7/383* (2013.01)

(58) Field of Classification Search

CPC .. A47C 7/383; A47C 7/36; A47C 7/38; A45F 4/02; A45F 2004/023; A45F 2004/026; A45F 2005/002

USPC ..... 224/257, 600, 602, 607; 383/41, 61.3

See application file for complete search history.

(56) References Cited

U.S. PATENT DOCUMENTS

| | | | | |
|---|---|---|---|---|
| 3,011,173 A * | 12/1961 | Goetz | A42B 1/006 2/171 |
| D302,775 S * | 8/1989 | Sinoff | D3/202 |
| 5,918,332 A * | 7/1999 | Dees | A47G 9/1045 383/4 |
| 6,206,223 B1 * | 3/2001 | Wicker | B65D 81/3879 220/375 |
| 6,397,403 B1 * | 6/2002 | Waldman | A41D 23/00 2/468 |
| 6,435,392 B1 * | 8/2002 | Kennedy | A45C 11/22 224/277 |
| D522,300 S * | 6/2006 | Roberts | A47C 7/383 D6/601 |
| 2007/0192961 A1 * | 8/2007 | Tidwell | A47D 13/08 5/655 |

* cited by examiner

*Primary Examiner* — Scott McNurlen

(74) *Attorney, Agent, or Firm* — Wayne Edward Ramage; Baker Donelson

(57) ABSTRACT

An elongated, flexible tubular container providing neck support for users during travel. The interior of the container is accessible through one or more openings at one or both ends of the container. The openings can be secured with angled zipper closures. Clothing items are inserted into the interior of the container during packing, and during travel, the container can be bent or arranged in a horseshoe shape or C-shape around the users neck or other body parts. The ends of the container may be secured to each other to hold the container in place. When the clothing is removed, the container is collapsed.

17 Claims, 12 Drawing Sheets

135
125
155
165
145
110
100
105
160
150
130
140
170
120

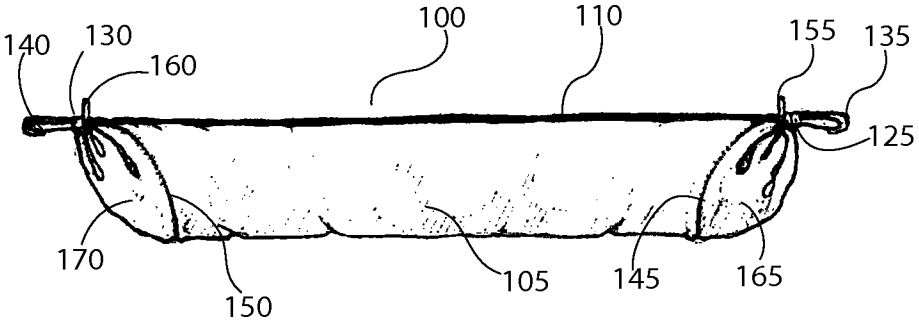
FIGURE 5
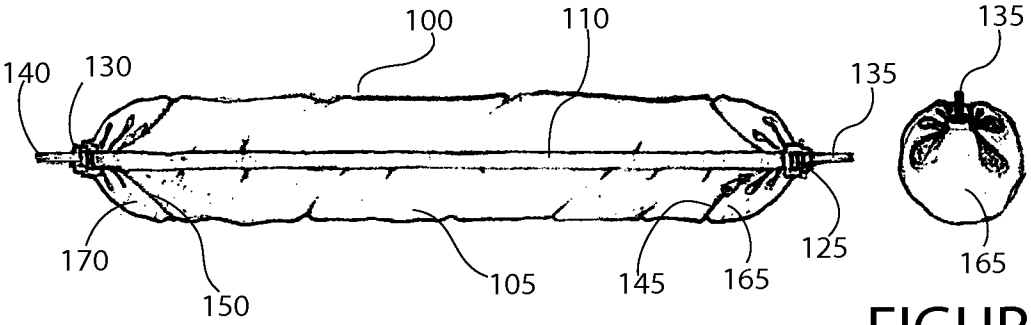
FIGURE 6
FIGURE 7

COLLAPSIBLE TRAVEL NECK SUPPORT TUBE

This application is a continuation-in-part of U.S. patent application Ser. No. 12/510,256, filed Jul. 27, 2009, and is entitled to that filing date for priority in whole or in part. The specification, figures and complete disclosure of U.S. patent application Ser. No. 12/510,256 are incorporated herein by specific reference for all purposes.

FIELD OF INVENTION

This invention relates generally to carriers and, more particularly, to a flexible tubular carrier configured to be attachable to other carriers or a removable strap, wearable around one's neck or waist, and used as a lumbar or neck pillow.

BACKGROUND OF THE INVENTION

Various non-luggage carriers exist for carrying, holding, supporting and storing objects. Such carriers include, by way of example, backpacks, duffel bags, fanny packs, satchels and purses. While such carriers are suitable for their intended purpose, their utility is limited, especially if used for travel. In most cases, these carriers constitute carry-on baggage, which modern airlines tend to limit in quantity and size. For example, backpacks and duffel bags tend to be cumbersome and must be stored in an overhead bin or beneath a seat during commercial airline travel.

In addition, many are too large or too small. Frequently, they lack attachments that are versatile enough to connect to other carriers and to be worn. They are unsuitable as neck and back pillows. They do not function independently as carrier straps. Fanny packs, small hands-free carriers with belts for wearing around users' waists, are suitable substitutes for a small purse and useful for carrying small items such as a wallet, keys and the like. However, fanny packs are generally inadequate for storing larger items such as garments. Satchels and purses must be carried by hand and frequently lack storage capacity suitable for garments. None of the aforementioned carriers easily attach to luggage without dragging or may function as a carrier strap. Furthermore, such carriers are not adaptable to be worn around one's neck or lumbar region as a travel pillow.

As an example, U.S. Pat. No. 4,523,703 to McKenna describes a carrier that attempts to fill a void left by conventional fanny pack carriers as described above. McKenna provides a torso-encircling carrier with a tubular body having a central closed tubular portion and tapered ends. The tubular body, which is "adapted to encircle the torso of the wearer," is intended to carry a coat. Longitudinal zipper closures are provided along the tapered ends and the central tubular portion. Such a carrier featuring a tubular body adapted to encircle the torso of a wearer is not configured and sized for wearing around one's neck. Additionally, the McKenna carrier lacks any provisions for functioning as a carrier strap. The end attachments of the McKenna carrier are not versatile enough to connect to other carriers. No provision is made for additional storage compartments. Furthermore, the longitudinal zipper closures of the McKenna carrier complicate loading and closure. Garments must be held in their folded state while the longitudinal zippers are pulled to a closed position. Otherwise, the garment would tend to unfold and become snagged by the zipper. Such longitudinal zippers are also more prone to failure, especially if the carrier is loaded with a thick garment.

Accordingly, what is needed is a carrier suitable for storing one or more items such as garments and configured to be attachable to other carriers or a removable strap, wearable around one's neck or waist, and usable as a lumbar or neck pillow. Additionally, the carrier should be easy to load.

SUMMARY OF INVENTION

In various embodiments, the present invention comprises a flexible tubular carrier suitable for storing one or more items such as garments and configured to be attachable to other carriers or a removable strap, wearable around one's neck or waist, and usable as a lumbar or neck pillow. The present invention is not considered carry-on baggage by airlines, and thus avoids limitations on weight and size, and also does not count against the user's carry-on baggage count.

Additionally, the carrier is easy to load. The carrier features a flexible tubular body, opposite flexible end covers, and angled zipper closures adjoining the end covers to the tubular body. Items such as garments may be rolled and inserted or pulled into the tubular container. Straps and connectors are provided to wear the carrier over one's shoulder or around one's neck or waist and to attach the carrier to other carriers. The carrier may be filled with relatively soft items, such as rolled-up garments, bent into a horseshoe shape and be comfortably fastened and worn around one's neck to facilitate carrying and serve as a cushion and head support. Alternatively, the carrier may be worn around one's lower back to provide lumbar support and cushioning. Additionally, the carrier may be worn over one's shoulder and used as a cushioned strap to support another carrier. Uniquely angled zippers facilitate easy access to stored items. When opened, at least one zipper reveals a drop-down pocket attached to the interior of the container.

In one embodiment, a wearable flexible tubular carrier according to principles of the invention includes an elongated flexible sheath body having a longitudinal axis, an exterior surface, an interior surface, a first open end with a free edge and an opposite second open end with a free edge, with two end-caps or end covers attached thereto. The end-caps or end covers may be permanently attached to the body. The elongated flexible sheath body defines an interior compartment. A webbing spine is attached to the exterior surface of the elongated flexible sheath body and extends across the entire elongated flexible sheath body and end-caps substantially parallel to the longitudinal axis. The webbing spine has a first end and a second end. A first flexible end-cap or end cover has a free edge releasably fastened to the first open end of the elongated flexible sheath body. A second flexible end-cap or end cover has a free edge releasably fastened to the second open end of the elongated flexible sheath body. A first connector (e.g., clip, hook, D-ring, O-ring, karabiner, hook and loop fastener or the like) is attached to the first end of the webbing spine. A second connector (e.g., clip, hook, D-ring, O-ring, karabiner, hook and loop fastener or the like) is attached to the second end of the webbing spine. A first fastener (such as a first zipper fastener) releasably joins the free edge of the first flexible end-cap to the free edge of the first open end of the elongated flexible sheath body. A second fastener (such as a second zipper fastener) releasably joins the free edge of the second flexible end-cap to the free edge of the second open end of the elongated flexible sheath body.

The free edge of the first open end of the elongated flexible sheath body and the first fastener is preferably oriented at an acute angle relative to the longitudinal axis. Likewise, the free edge of the second open end of the elongated flexible sheath body and the second fastener may be oriented at an acute angle relative to the longitudinal axis.

Optionally, a belt may be attached to the carrier. Such a belt may have a first end, an opposite second end, a first belt connector attached to the first end of the belt and a second belt connector attached to the second end of the belt. The first belt connector attaches to the first connector, which is attached to the first end of the webbing spine. The second belt connector attaches to the second connector, which is attached to the second end of the webbing spine.

The wearable flexible tubular carrier is configured for wearing around a neck as a head support. Accordingly, the elongated flexible sheath body has a size configured for wearing the carrier around a user's neck. The size for adults includes a length of 24 to 36 inches (preferably 28 to 32 inches, and more preferably 30 inches) and an average circumference of 6 to 13 inches (preferably 10 to 12 inches). Smaller sizes for children may also be available. Additionally, the first connector (e.g., a clip) attached to the first end of the webbing spine is configured to connect to the second connector (e.g., a ring) attached to the second end of the webbing spine. When the first and second connectors are connected, the carrier maintains a horseshoe or U-shaped configuration around a user's neck. This configuration is also suitable for several other purposes, including using the carrier as a shoulder strap attached to a load, wearing the carrier around a user's waist or lower back when a belt is connected to the carrier, and attaching the carrier to totes and luggage without dragging.

In several embodiments, a flexible pocket is attached to the interior surface of the elongated flexible sheath body. The pocket provides a supplemental container for items such as a passport. The pocket has an interior compartment and a zippered opening for access to its interior compartment. The flexible pocket is attached to the interior surface adjacent to the first open end of the elongated flexible sheath body, with at least a portion of the pocket extending outside of the interior compartment of the elongated flexible sheath body when the pocket is unfolded and the free edge of the first flexible end cover is released from the free edge of the first open end of the elongated flexible sheath body. The pocket is referred to as a drop-down pocket because the exposed portion of the pocket tends to unfold and drop down when the corresponding end of the carrier is opened.

A supplemental zippered opening, referred to as a pocket opening, may be provided in the elongated flexible sheath body to facilitate access to the pocket without opening the end cover. In one embodiment, the pocket opening is positioned beneath and concealed by the webbing spine when not in use. The tube may be stored by packing it into said pocket. Users may insert thumbs in each end or side of the pocket and gather the tube by effectively turning it inside out, in a similar manner to the way one would fasten a pair of socks.

BRIEF DESCRIPTION OF THE DRAWINGS

FIG. 5 is a front view of another exemplary flexible tubular carrier according to principles of the invention.

FIG. 6 is a plan view of the other exemplary flexible tubular carrier according to principles of the invention.

FIG. 7 is a side view of the other exemplary flexible tubular carrier according to principles of the invention.

DETAILED DESCRIPTION OF EXEMPLARY EMBODIMENTS

Figure 1:
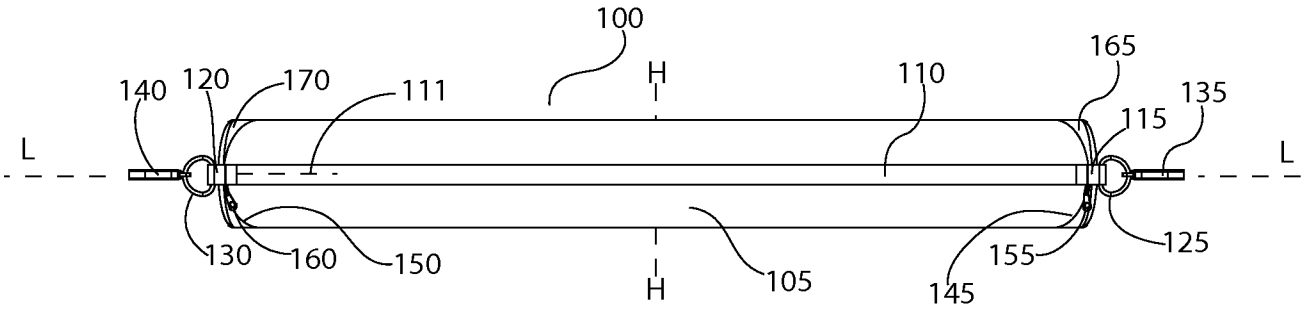
FIG. 1 is a plan view of an exemplary flexible tubular carrier according to principles of the invention.

In various exemplary embodiments, the present invention comprises a flexible tubular carrier 100. As seen in FIG. 1, carrier 100 comprises a flexible sheath-like body 105, which defines an interior compartment 185 for storage, as shown in FIGS. 4, 4A, 8 and 10. While the body 105 is referred to herein as a tubular body 105, the term tubular does not connote or require a circular cross-section or any particular shape cross-section. Skilled artisans will appreciate that the flexible body 105 may have varying cross-sectional shapes depending, at least in part, upon design preferences, whether the body is filled, to what extent it is filled, and the shape, position, orientation and rigidity of objects contained in the body 105.

The exterior of the exemplary carrier 100 is symmetrical. The axis of symmetry is line H-H. However, the principles of the invention are not limited to symmetrical embodiments. Asymmetrical embodiments are intended to come within the scope of the invention.

One or both ends comprises an opening, which may be at or near the end. The opening may extend partway around the container, or completely. A fastener, such as a zipper 155, 160, may be used open or close the opening. A flexible end-cap, end flap or cover 165, 170 may be formed or provided at each end of the tubular body 105. The end-caps, end flaps or end covers may be permanently attached to, or be part of, the body 105. A fastener, such as a zipper fastener 155, 160, releasably joins free edges of each end cover 165, 170 to corresponding free edges 145, 150 of the tubular body 105. In a preferred embodiment, the zipper fastener 155, 160 extends around most, but not all of the periphery of the tubular body 105. Each flexible end cover 165, 170 is attached to the tubular body 105 at an attached portion of the tubular body 105 which the zipper fastener 155, 160 does not cross. Thus, even when the zipper fastener 155, 160 is fully open, the end cover 165, 170 remains attached to the body 105 at the attached portion 102. Such attachment facilitates closure of the zipper fastener 155, 160 and prevents separation and loss. Alternatively, the end cover may be entirely removable from the body. Although zipper fasteners are shown and discussed, other closures such as hook-and-loop fabric, drawstrings, buttons, snaps, and/or magnetic closures may be provided in addition to or in lieu of the zipper fasteners, and are intended to come within the scope of the invention.

A spine comprising a flexible band or strap 110 (e.g., webbing) extends along a longitudinal axis L-L of the tube body, including the end covers 165, 170. The spine 110 may cover a seam in the tubular body 105. Connectors, such as a D-ring 125, 130 and a clip 135, 140, are attached to each end of the spine 110. As a strong fabric woven as a flat strip or tube, the spine 110 is particularly well suited for withstanding substantial tensile loads. Thus, loads experienced by the connectors, such as a D-ring 125, 130 and a clip 135, 140, are transmitted to the strong spine 110, rather than to the body 105 of the carrier 100. This configuration helps maintain physical integrity of the carrier 100, even when the connectors experience a substantial load.

Figure 9:
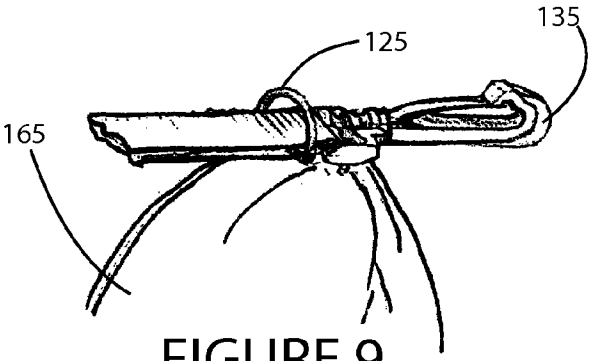
FIG. 9 is a perspective view of an end with a D-ring and clip attachment for the other exemplary flexible tubular carrier according to principles of the invention.

The selection, arrangement and configuration of connectors is not particularly important, so long as means for attaching each end of the carrier 100 together and to compatible hardware is provided. The connectors may be removable or permanently attached to the ends of the spine 110. The connectors may also be directly or indirectly attached to the ends of the spine 110. By way of example, a D-ring 125, 130 may be attached to each end of the spine 110 and a clip may be temporarily or permanently attached to each D-ring 125, 130. Alternatively, a D-ring 125, 130 may be attached to the spine 110 at or near the end of the strap and a clip 135, 140 may also be attached to the strap 100 at or near each end, as illustrated in FIG. 9. The connectors allow each end of the carrier 100 to connect together, as discussed in more detail below. The connectors also allow each end of the carrier 100 to connect to other compatible hardware. For example, the clips 135, 140 may connect to an adjustable belt 180, as conceptually illustrated in FIG. 16, or to compatible hardware on another carrier. Thus, for example, O-rings, buckles, carabiners, hook and loop fasteners, cord locks, lanyards, shock cords and the like may be provided in addition to or in lieu of some or all of the exemplary D-rings 125, 130 and clips 135, 140 shown in the figures.

Figure 2:
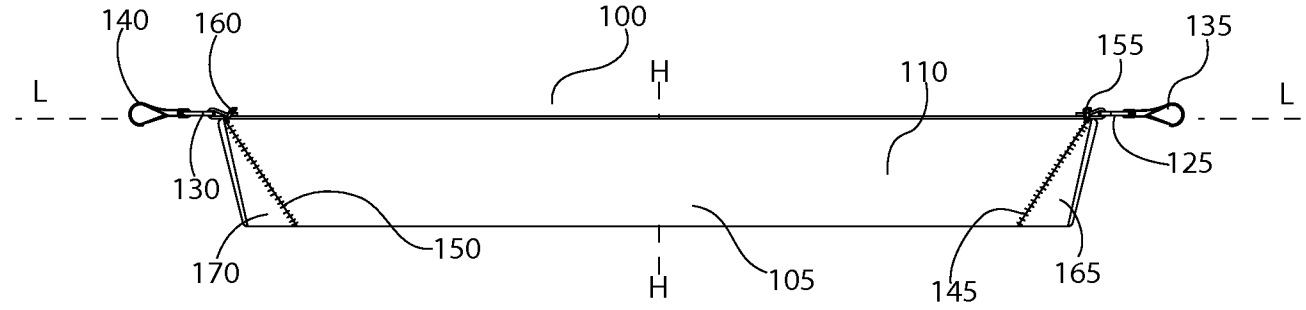
FIG. 2 is a front view of an exemplary flexible tubular carrier according to principles of the invention.
Figures 4, 4A:
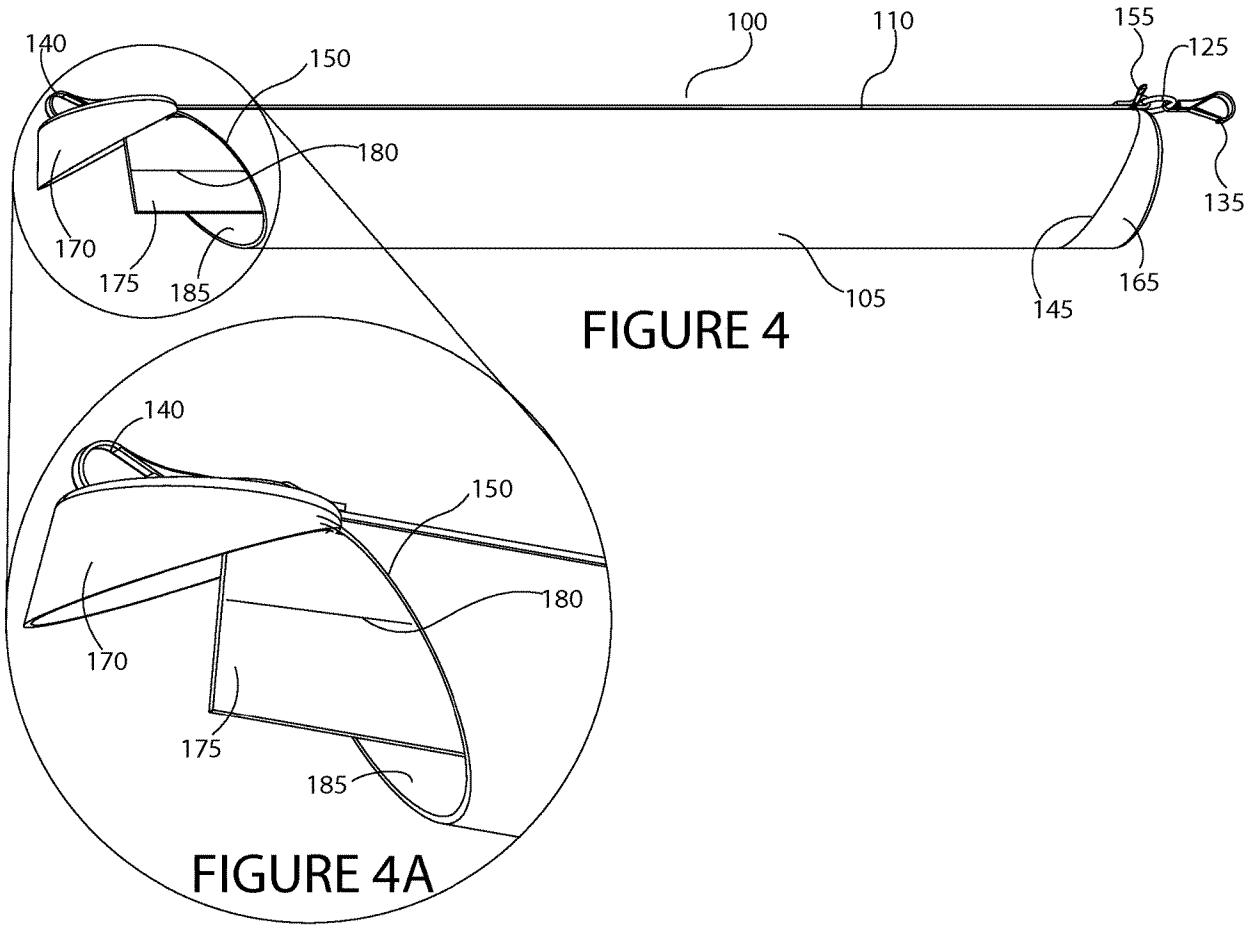
FIG. 4 is a perspective view of an exemplary flexible tubular carrier with an open end and drop down pocket according to principles of the invention.
FIG. 4A is a magnified view of an open end of an exemplary flexible tubular carrier with a drop down pocket according to principles of the invention.
Figure 11:
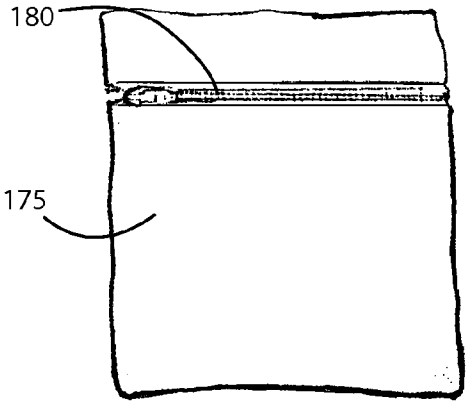
FIG. 11 is a front view of an exemplary drop-down pocket for use with the other exemplary flexible tubular carrier according to principles of the invention.

FIG. 2 provides a front view of the exemplary flexible tubular carrier according to principles of the invention. Significantly, the free edges 145, 150 of the exemplary tubular body 105 which are temporarily joined to corresponding free edges of each end cover 165, 170, are oriented at an acute angle, θ. The angle, θ, is determined relative to the longitudinal axis of the body 105 (e.g., the spine 110), measured when the body 105 is laid substantially flat. By way of example and not limitation, θ may be between 45° and 80°. This angular configuration facilitates access to and removal of contents of the tubular body 105. This angular configuration also facilitates exposure of and access to a drop down pocket 175 attached to the interior surface of the tubular body 105, as illustrated in FIGS. 4, 4A and 11. Without an acute angular configuration, no portion of the drop down pocket 175 would be exposed and easily accessible when the corresponding end cover 170 is opened. The drop down pocket 175 is discussed more fully below.

The free edges 150 of the exemplary tubular body 105 may be linear or nonlinear, e.g., curved or irregularly shaped. If the edges are nonlinear, then the angle, θ, relative to the longitudinal axis of the body 105 may be determined as an average along the length of the free edge, measured from the spine 110. Illustratively, the average angle, θ, of n tangent lines at n equally spaced points along the edge, may be considered an average angle, θ. The average is less than 90°.

Figures 3, 3A:
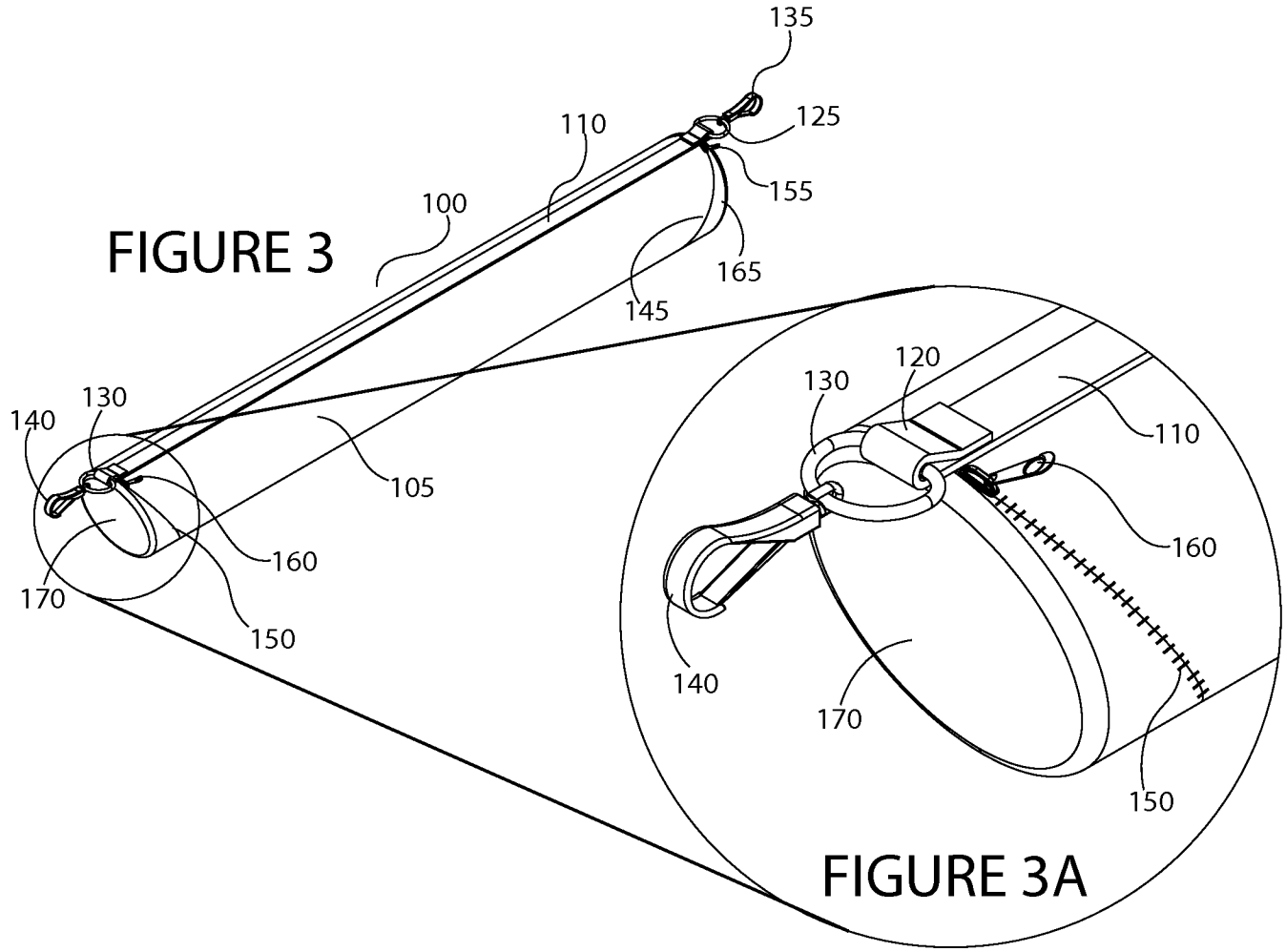
FIG. 3 is a perspective view of an exemplary flexible tubular carrier according to principles of the invention.
FIG. 3A is a magnified view of an end of an exemplary flexible tubular carrier according to principles of the invention.

FIGS. 3 and 3A provide perspective and magnified portion views of an exemplary flexible tubular carrier according to principles of the invention. The magnified view in FIG. 3A shows a D-ring 130 attached to the end 120 of the spine 110. A swivel clip 140 is attached to the D-ring 130. The clip 140 may be attached to either the opposite clip 135 or D-ring 125 on the opposite side of the carrier 100. The zipper fastener 160 is shown in a closed position with the free edges of the end cover 170 connected to the free edges of the tubular body 105.

FIGS. 4 and 4A provide perspective and magnified portion views of an exemplary flexible tubular carrier according to principles of the invention. The magnified view in FIG. 4A shows the zipper fastener 160 in an open position with free edges of the end cover 170 separated from the free edges of the tubular body 105. The flexible end cover 170 is moved (i.e., pivoted) away from the tubular body 105. The interior compartment 185 of the tubular body 105 is revealed.

The structure of the carrier 100 facilitates loading. Objects (e.g., rolled up garments) may be urged into the interior compartment from either end opening. Concomitantly, objects may be pulled into the interior compartment 185 from the opposite end opening. In some cases, the tubular body 105 may be slid onto the object to be loaded. As the objects are loaded, the tubular body 105 retains them in their rolled condition. As it is unnecessary to slide a zipper across the length of the tubular body, there is no risk of the loaded items unraveling and becoming snagged in a zipper. Small items may easily be placed into the interior compartment 185.

In some embodiments, the interior compartment 185 contains a flexible pocket 175 for storing items, such as a wallet, license, passport, boarding pass or the like. The pocket includes a closure, such as a zipper fastener 180, which may be reversible. A portion of the pocket 175 is attached to the interior 185 of the tubular body 105 near the free edges 150 of the tubular body 105. In a particular embodiment, a portion of an edge of the pocket 175 nearest the spine 110 is attached to the interior 185 of the tubular body 105 near the free edges 150 of the tubular body 105. The pocket 175 is positioned so that, when the zipper fastener 160 is opened and the end cover 170 is moved away from the free edges 150, a portion of the pocket 175 may be exposed. The portion may be exposed because the free edges 150 are at an acute angle relative to the longitudinal axis of the carrier 100. In a preferred embodiment, if the carrier is held upright, i.e., with the strap at top, and the zipper fastener 160 is opened and the end cover 170 is moved away from the free edges 150, the flexible pocket 175 drops down and is partially exposed, as conceptually illustrated in FIG. 4A. Either or both sides of the carrier may contain a pocket 175. Additionally, the tubular body 105 and connectors and any straps may be stored in the flexible pocket 175.

Referring now to FIGS. 5, 6 and 7, front, plan and profile views of another exemplary flexible tubular carrier according to principles of the invention are provided. In this embodiment, the end covers 165, 170 have a clam shell shape. However, the invention is not limited to any particular shape of end cover, so long as the end cover includes free edges configured to temporarily attach to the free edges of the tubular body 105.

Figure 8:
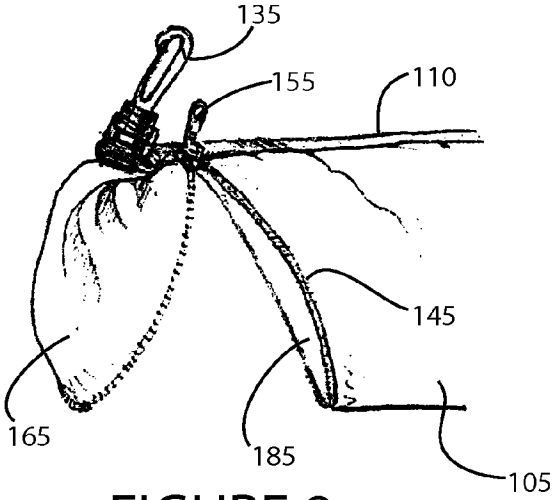
FIG. 8 is a perspective view of an open end of the other exemplary flexible tubular carrier according to principles of the invention.

FIG. 8 provides a perspective view of an open end cover 165 (e.g., back perspective view of the open right-side end cover 165). The free edges 145 are clearly revealed along with the interior compartment 185. The zipper fastener 155 is in the open position. A clip 135 is provided for attachment to either hardware at the opposite end, a strap or other items. FIG. 9 provides a perspective view of the end cover 165 with a D-ring 125 and clip 135, each of which is connected to the spine 110.

Figure 10:
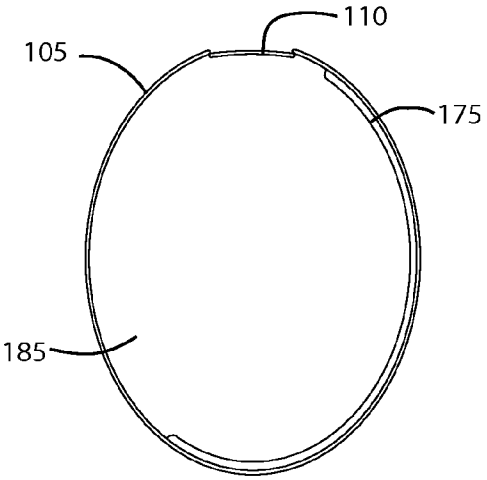
FIG. 10 is a section view of the other exemplary flexible tubular carrier according to principles of the invention.

FIG. 10 provides a section view showing the flexible tubular body 105 and defined interior space 185 in a circular, oval or elliptical configuration. The particular shape shown is not important. The material comprising the tubular body 105 adjoins the spine 110. The flexible interior pocket 175 is attached to the interior surface of the tubular body 105.

FIG. 11 provides a front view of the exemplary flexible drop-down pocket for use with the other exemplary flexible tubular carrier 100 according to principles of the invention. The pocket 175 comprises an envelope or container with an opening for inserting and removing items that will fit in an interior space provided therein. In the exemplary embodiment, the opening is temporarily closed using a zipper fastener 180. The zipper fastener 180 may be reversible. While a rectangular shape pocket 175 is shown, the pocket is not limited to any particular shape, so long as it is configured to hold items. The pocket is also not limited to any particular size. However, a 7-inch by 7-inch rectangular pocket is preferred. Optionally, the tubular body 105 may include an additional zipper assembly, such as a zipper assembly 111 hidden under the webbed spine 110, to facilitate access to the pocket 175 without opening the ends of the carrier 100. Additionally, the tubular body 105 and connectors and any straps may be stored in the flexible pocket 175. The tube may be stored by packing it into said pocket. Users may insert thumbs in each end or side of the pocket and gather the tube by effectively turning it inside out, in a similar manner to the way one would fasten a pair of socks.

Figure 13:
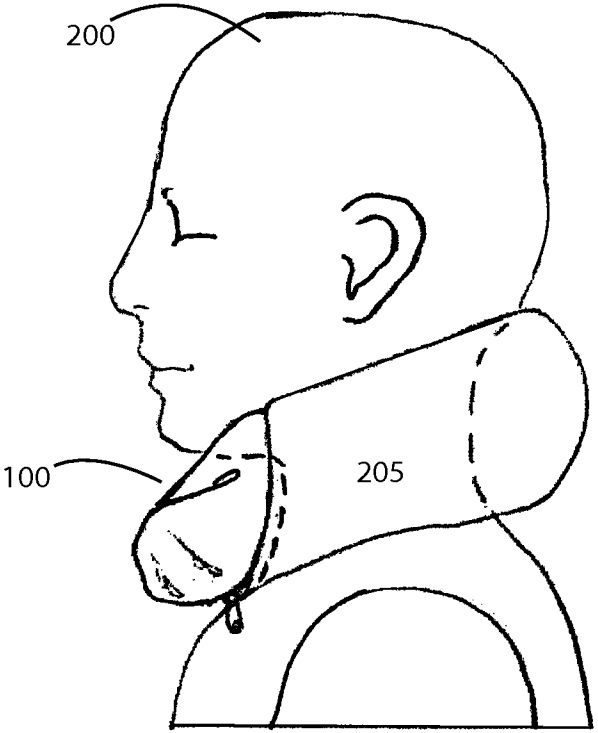
FIG. 13 is a side view of an exemplary flexible tubular carrier worn around a user's neck according to principles of the invention.
Figure 12:
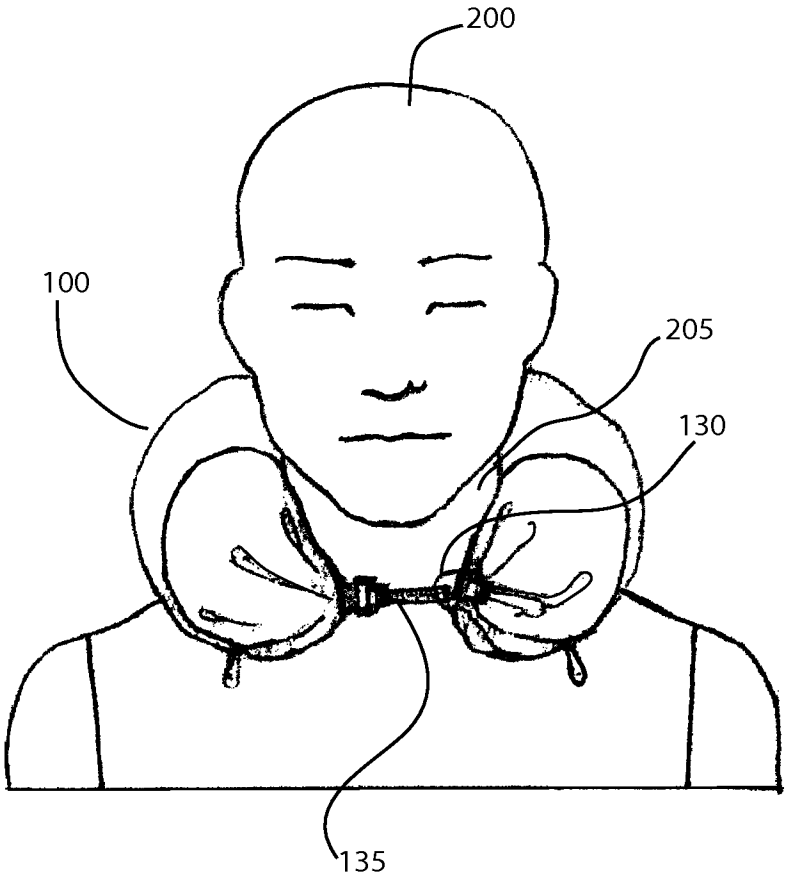
FIG. 12 is a front view of an exemplary flexible tubular carrier worn around a user's neck according to principles of the invention.
Figure 14:
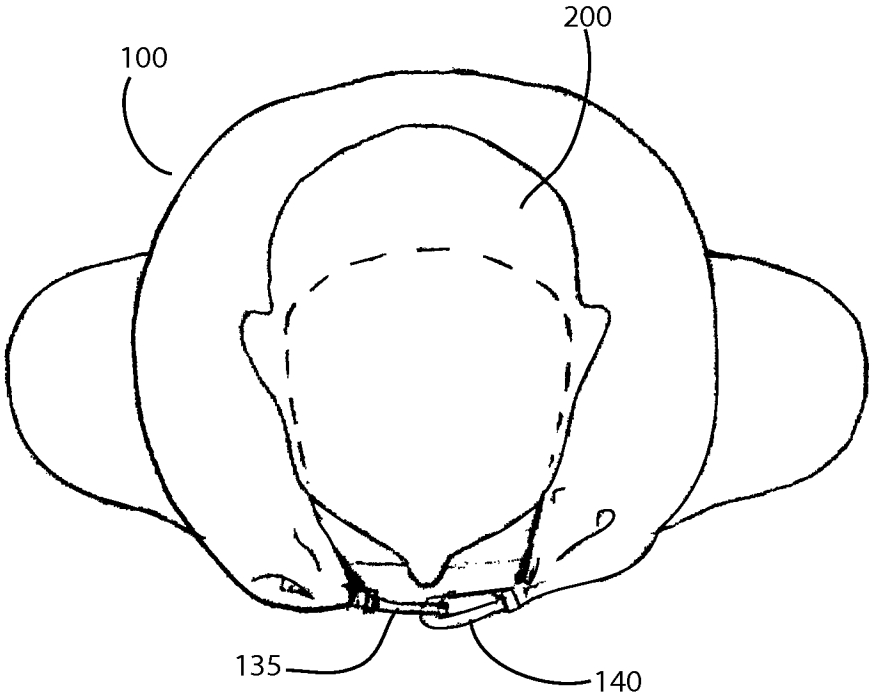
FIG. 14 is a top view of an exemplary flexible tubular carrier worn around a user's neck according to principles of the invention.

FIGS. 12, 13 and 14 provide front, profile and top views of an exemplary flexible tubular carrier 100 worn around the neck 205 of a user 200 according to principles of the invention. The carrier 100 may contain soft, flexible, supportive items, such as rolled up garments, towels and the like. The tubular carrier is sized to accommodate a user's neck 205 when bent into a U-shape, C-shape, or horseshoe shape. Adult and children sizes may be provided. Opposite ends of the carrier 100 may be linked using the available connectors. For example, a clip 135 at one end may connect to a clip 140 or a D-ring 130 at the opposite end. When the ends are so linked, the carrier 100 may be maintained in the U, C or horseshoe shape, surrounding the user's neck 205, as illustrated in the figures. Thus, the carrier 100 may be carried hands free. Concomitantly, the carrier 100, when so configured, functions as a travel pillow.

Configured as a travel pillow, the carrier 100 offers several advantages. First, the carrier 100 adjusts to the user's neck and supports the user's head when sitting upright. Such support relieves stress on the cervical portion of the human spine as well as the nerves and muscles in the neck. Second, the contents of the carrier 100 may be selected and arranged to provide support and comfort to suit a user's preferences. For example, the carrier may be tightly or loosely packed, with flexible items of any softness. When filled tightly with clothes, the carrier is much firmer than conventional air, foam and bead filled travel pillows, and therefore more supportive for the neck and especially behind the back. Additionally, the clothes, size and shape of the carrier 100 provide superior vibration and temperature insulation when the carrier 100 is used against the cold airplane side wall. Third, the carrier 100 serves its primary function as a tote, while also serving as a travel pillow.

To function as a travel pillow, the carrier 100 may be configured to wrap around a substantial portion of a user's neck and then remain in place. An adult neck is approximately 12 to 20 inches in circumference. The shape and size of the exemplary carrier 100 accommodate this range of neck sizes. In an exemplary adult-sized embodiment, the tubular carrier body 105 is about 24 to 36 inches in length, l, preferably about 28 to 32 inches, and more preferably about 30 inches (±0.1 inch) long, with an average circumference of about 6 to 13 inches, preferably about 10 to 12 inches. As the circumference may vary along the length of the body 105, an average circumference may be determined from circumferences measured at a plurality of equally spaced points along the length of the body 105. Of course, for a configuration with a constant circumference, the average equals the circumference measured at any point along the length of the body 105. Such a configuration accommodates many adult neck sizes. Smaller size versions of the carrier 100 may be configured to accommodate children and petite individuals. Small, medium and large sizes may be configured to accommodate ranges of neck sizes from a small size for children and petite adults, a medium size for average adults, and a large size for plus-size adults.

Alternatively, a more conventional pillow shape may be formed. The body 105 of the carrier 100 may be folded completely at about its midpoint. Then a strap may be wrapped around the folded sections to hold the folded structure together. The secured structure can be used as a pillow for one's head or behind one's back or between one's knees.

Figure 18:
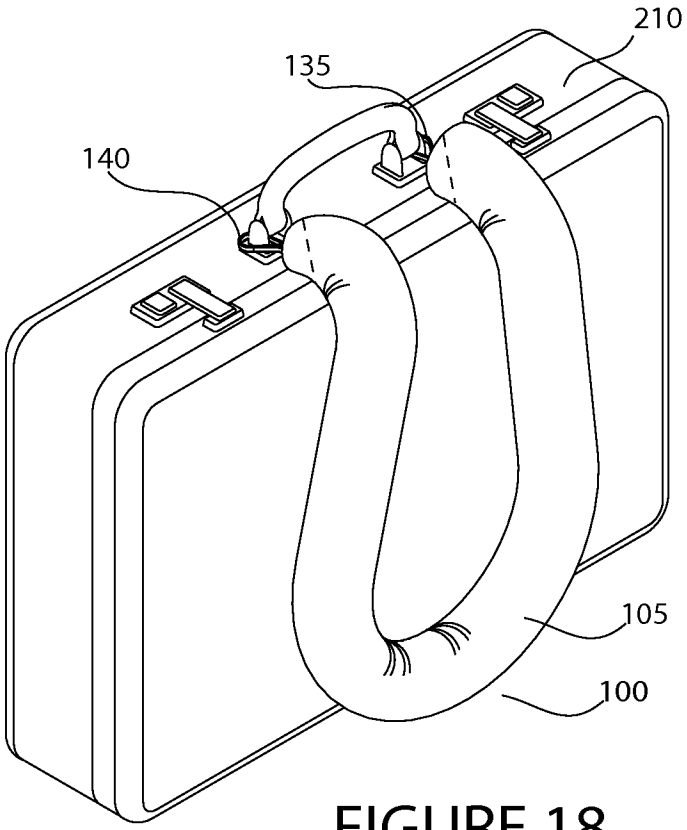
FIG. 18 is a perspective view of an exemplary flexible tubular carrier suspended from a briefcase according to principles of the invention.

As a related advantage, the connectors and size of the carrier (i.e., about 24 to 36 inches in length) enable attachment of the carrier 100 to existing luggage, briefcases, totes or the like, without dragging. For example, the carrier may be bent into a U-shape and connected at each end to hardware available on a briefcase 210, luggage, duffel bag or the like, as shown in FIG. 18. Such hardware may include D-rings, O-rings, karabiners, clips, hooks, handle assemblies, buckles, straps or similar features available on many modern briefcases, luggage, duffel bags and the like.

Figure 15:
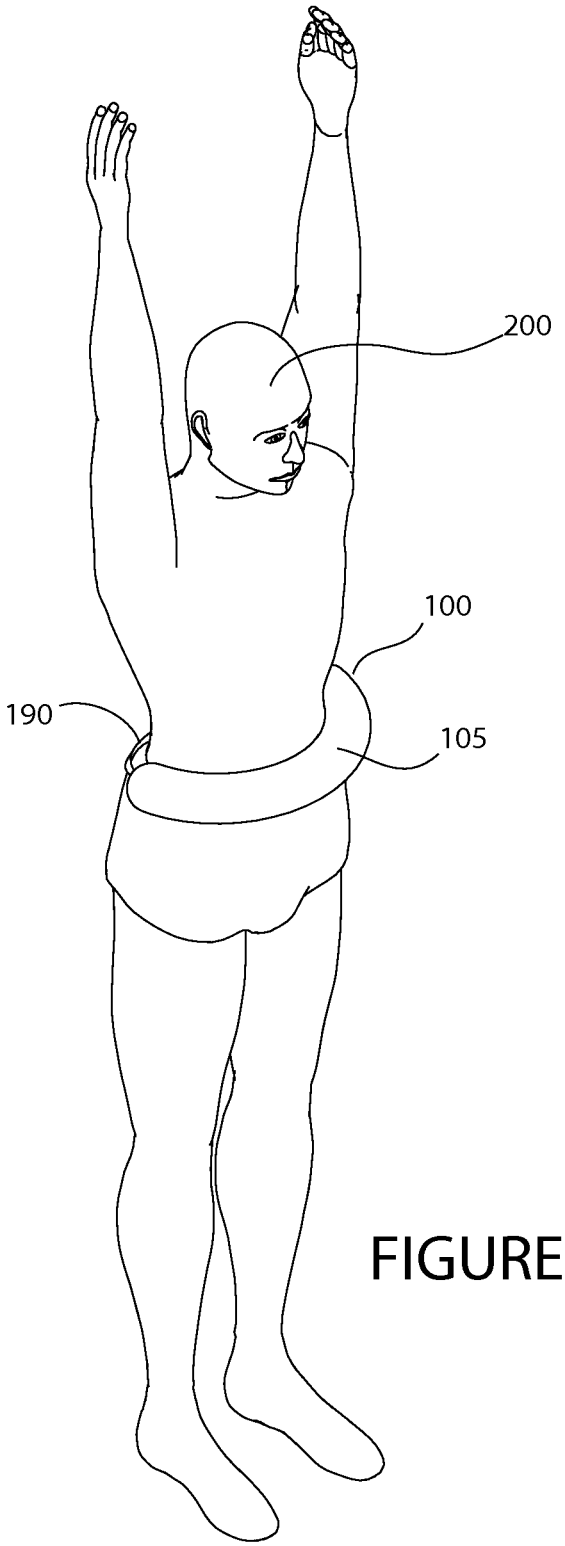
FIG. 15 is a perspective view of an exemplary flexible tubular carrier worn around the front of a user's waist according to principles of the invention.
Figure 16:
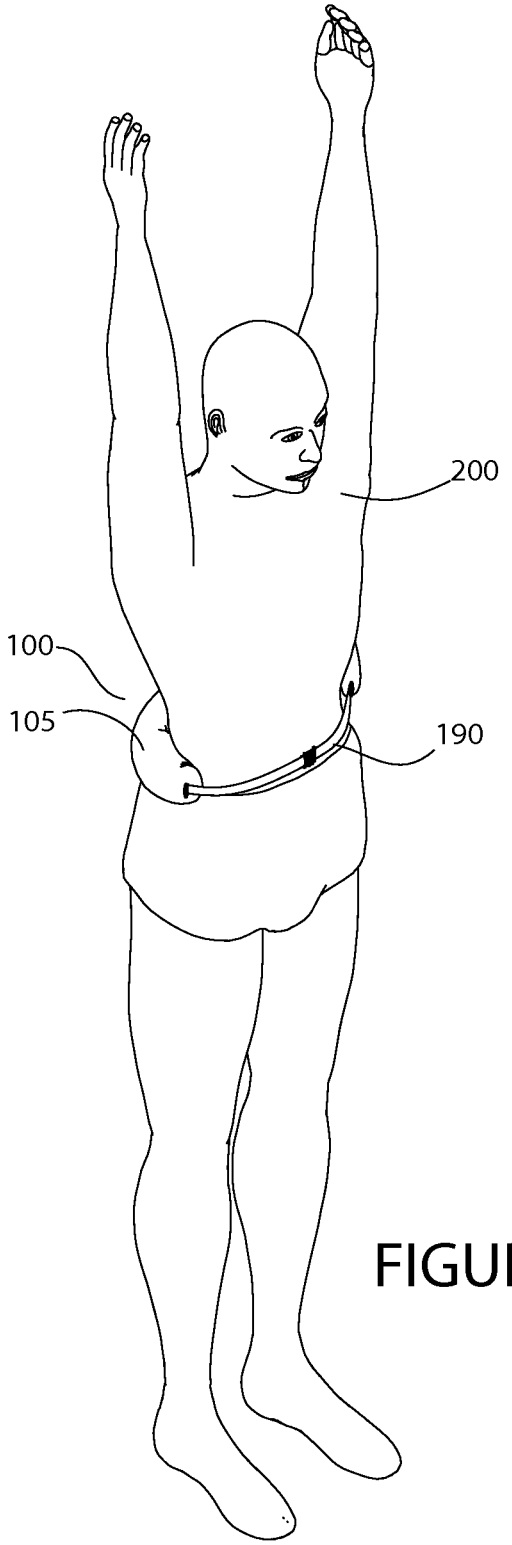
FIG. 16 is a perspective view of an exemplary flexible tubular carrier worn around the lumbar region of a user according to principles of the invention.

FIGS. 15 and 16 provide perspective views of an exemplary flexible tubular carrier 100 worn around a user's waist or lower back using a belt 190 attachable to the connectors, e.g., the D-rings 125, 130 and/or clips 135, 140. In FIG. 15, the carrier 100 is shown in the front of the user 200. The flexible carrier 100 may be worn in the front, along a side or in the back of the user 200. The carrier 100 may contain soft, flexible, supportive items, such as rolled up garments, towels and the like. The tubular carrier 100 is flexible to conform to the shape of a waist. Opposite ends of the carrier 100 may be linked to compatible ends of a belt using available connectors. For example, a clip 135, 140 at each end of the carrier may connect to a clip or a D-ring at each end of a belt. Alternatively, a D-ring 125, 130 at each end of the carrier may connect to a clip at each end of a belt. When the ends of a belt are so linked, the carrier 100 may be secured at a user's waist or lower back, hands-free.

Figure 17:
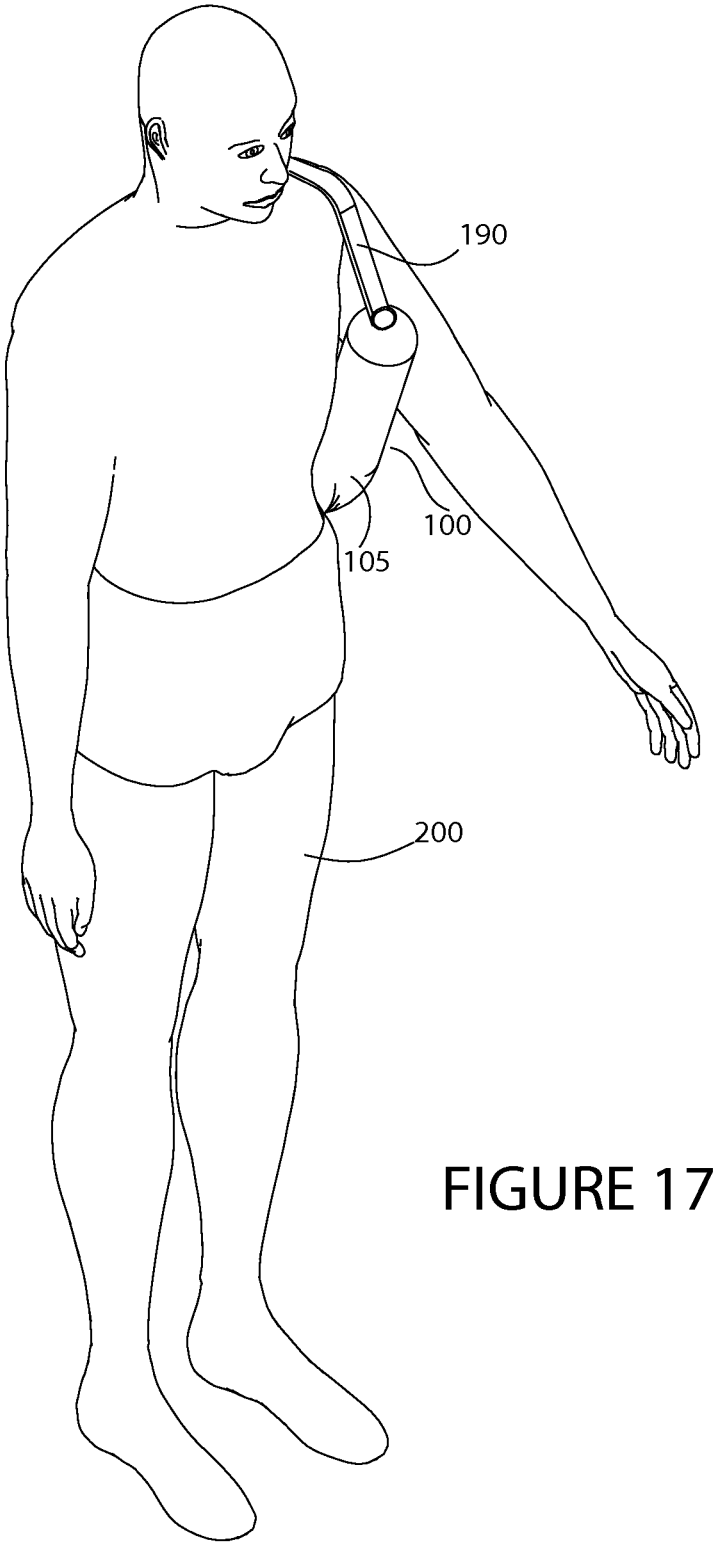
FIG. 17 is a perspective view of an exemplary flexible tubular carrier worn around a shoulder of a user according to principles of the invention.

Concomitantly, the carrier 100, when so configured, may be positioned along the lumbar region of a user's lower back to functions as a lumbar support pillow, as shown in FIG. 16. Such support relieves stress on the lumbar portion of the human spine as well as the nerves and muscles in the lower back. Of course, the contents of the carrier 100 may be selected and arranged to provide support and comfort to suit a user's preferences. For example, the carrier may be tightly or loosely packed, with flexible items of any softness. Alternatively, the carrier may be carried by the strap over a user's shoulder, as shown in FIG. 17.

In another configuration, the carrier may be used as a carrying strap, e.g., a shoulder strap. By way of example, one or more of the connectors at each end of the carrier may be directly or indirectly secured to a load, such as a duffel bag, brief case, luggage, garment bag or the like. The carrier may be bent over and supported upon one's shoulder. The spine 110 may be positioned on top, with the carrier body 105 between the user's shoulder and the spine 110. Thus, the contents of the carrier will cushion the user's shoulder.

Figure 19:
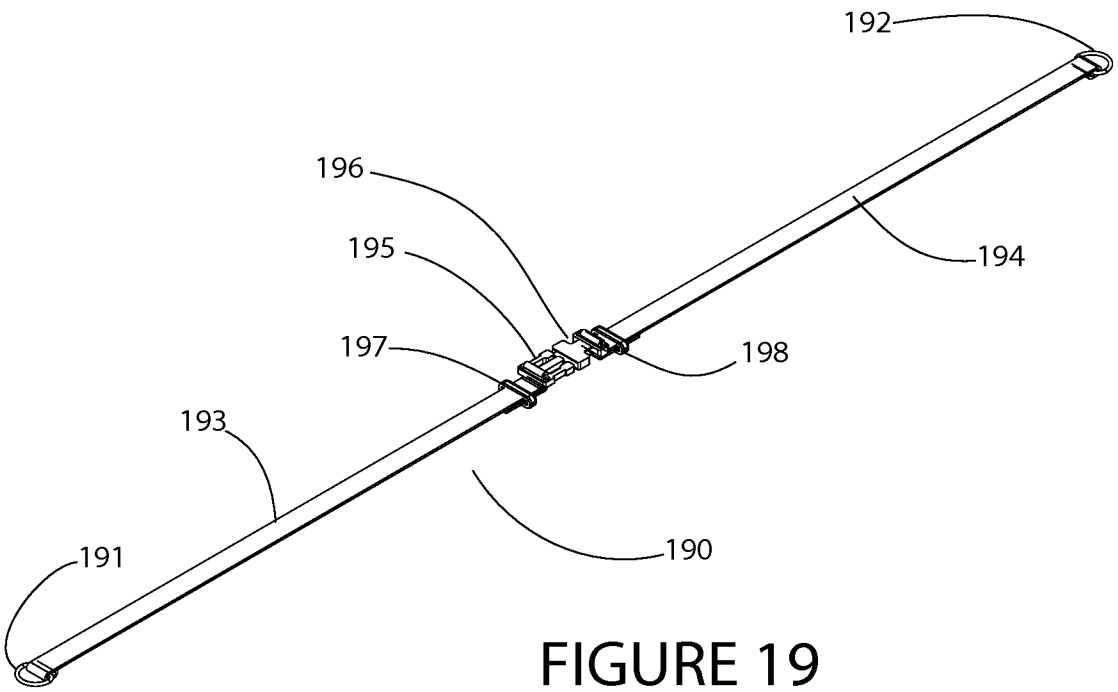
FIG. 19 is a perspective view of an exemplary strap for a flexible tubular carrier according to principles of the invention.

The carrier may be used with many different types of belts and straps that include hardware that is compatible with the connectors of the carrier. Such hardware may, for example, include buckles, hooks, clips O-rings, D-rings, length adjusters, hook and loop fasteners, snaps, buttons, grommets and the like. Illustratively, FIG. 19 provides a perspective view of one exemplary belt 190 for a flexible tubular carrier according to principles of the invention. The exemplary belt 190 is comprised of a plurality of webbing straps 193, 194. The belt includes a side release buckle assembly comprising a male side release buckle portion 195 and a compatible female buckle portion 196. D-rings 191, 192 are provided at each end for attachment to the connectors of the carrier 100. Ladder lock length adjustment buckles 197, 198 may be an integral part of the male and/or female buckle portions, 195, 196, or provided separately on one or both sides of the belt 190 to facilitate release or tightening of the straps 193, 194.

The exemplary belt 190 in FIG. 19 provides a configuration that allows the buckle portions 195, 196, to remain centered such as in front at the midline of a wearer's body, where it is easy to access. Of course, the male and/or female buckle portions, 195, 196 are not necessary because connectors such as D-rings and clips at the end covers 165, 170 allow connection and disconnection. Additionally, one length adjustment mechanism 197, 198 will typically suffice. Thus, embodiments without the buckle portions 195, 196 and with one or more length adjustments 197, 198, or without any length adjustments, come within the scope of the invention.

The flexible material comprising the tubular body 105 and end covers 165, 170 may be one or more fabrics having the desired properties commensurate with the intended end use of the carrier. Such properties may include, light weight, comfort against the user's skin, good mechanical properties, some elasticity, possibly water and UV resistance. Preferably, the flexible material is synthetic, although natural materials, such as cotton, and blends can be used in some embodiments. Woven or knitted fabrics may be used. Suitable synthetic materials include nylon and polyester containing materials. The flexible material may advantageously include two or more layers of fabric, possibly laminated together. Further, while the present invention has been described above as being filled with clothing items, it should be noted that the invention can be stuffed with other material, as desired (including, but not limited to, with foam, batting, buckwheat, or similar materials).

The carrier may be constructed using various techniques. As one non-limiting example, the tubular body may be formed from a sheet of fabric approximately 13 inches wide and 34 inches long that is folded in half. Circular shaped end covers may be cut from the end and then rejoined with a zipper fastener. An O-ring or D-ring and swivel clip may be slid onto a webbed spine. The remaining open ends may then be gathered around the webbed spine and sewn to hold the O-ring and swivel clip in place and to finish the end with a tapered closing. A 7-inch by 7 inch zippered pocket may be sewn to the inside seam near an open end so that it can swing freely and be accessed when the corresponding end of the carrier is opened. The pocket may hold small items such as a passport.

Another advantage of a carrier according to principles of the invention is storability. It easily fits in an overhead bin and other compartments during travel. Additionally, as of the time of this application, many modern US airlines do not considered it to be a "piece of luggage" or carry-on bag. Instead it is generally regarded as a personal item.

Another advantage of a carrier according to principles of the invention is versatility. It may readily be configured for hand-free wearing around one's neck or waist and supporting on one's shoulder. It may serve as a pillow, ergonomic lumbar or head support, and, of course, as a carrier.

Another advantage of the present invention is adjustability as a neck support. A single tube can fit various neck sizes and retains its shape depending upon the amount, type and positions of clothing placed therein. This is a significant advantage over present art travel pillows, which are either stuffed or inflated. Stuffed travel pillows are not adjustable to provide support for every neck size, which requires different pillows be used for different neck sizes. Inflatable or bladder pillows are similarly limited with regard to a fixed size, and also frequently leak after several uses. The present invention thus provides customized neck and/or lumbar support to travelers in every mode of public or private transportation (e.g., planes, trains, buses, automobiles). It also provides extra storage with quick access to important items. In addition to travelers, the present invention can be used by motorcycle riders, horseback riders, skiers, hikers, amusement park goers, families with children, and the like.

While exemplary embodiments of the invention have been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A support carrier for travel, comprising:

an elongated, flexible tubular container body with a longitudinal axis, a top, a bottom, and two ends, each end comprising an opening allowing access to an interior of said container body and a flexible end cover adapted to close and open said opening by zippered attachment to the respective end, wherein the top of the container body is longer than the bottom of the container body so the zippered attachment at each end is oriented at an acute angle with respect to the longitudinal axis;

a flexible spine, with two ends, attached to and extending along the top of the container body, further comprising a connector at each end of the spine; and a plurality of clothing items arranged in the interior of said container body;

wherein in a first configuration the container body is flat and linear; and wherein in a second configuration the container body is adapted to be partially or wholly wrapped in a horseshoe shape around a user's neck as a head support, wherein the plurality of clothing items provide said support.

2. The support carrier of claim 1, wherein said container body is collapsible when the plurality of clothing items is removed from the interior.

3. The support carrier of claim 1, further wherein the connectors are adapted to connect to each other.

4. The support carrier of claim 1, wherein the connectors comprise an O-ring or D-ring.

5. The support carrier of claim 1, wherein the connectors comprise a swivel clip.

6. The support carrier of claim 1, wherein the ends are fastened together when used as a support.

7. The support carrier of claim 1, further comprising a drop-down pocket in the interior of the container body at one end.

8. The support carrier of claim 1, further wherein:

in a third configuration the container body with clothing inserted is adapted to be partially or wholly wrapped around a user's waist or lower back; and in a fourth configuration the container is adapted to be attached to a piece of luggage as an over-the-shoulder carrying strap.

9. A support carrier for travel, comprising:

an elongated, flexible tubular container body with a longitudinal axis, a top, a bottom, and two ends, each end comprising an opening allowing access to an interior of said container body and a flexible end cover adapted to close and open said opening by zippered attachment to the respective end, wherein the top of the container body is longer than the bottom of the container body so the zippered attachment at each end is oriented at an acute angle with respect to the longitudinal axis; and a flexible spine, with two ends, attached to and extending along the top of the container body, further comprising a connector at each end of the spine;

wherein in a first configuration the container body is flat and linear and is adapted to receive a plurality of clothing items inserted into the interior through one or both of said openings;

further wherein in a second configuration the container body with clothing inserted is adapted to be partially or wholly wrapped around a user's neck in a horseshoe shape as a head support, wherein the plurality of clothing items provide said support.

10. The support carrier of claim 9, wherein said container body is collapsible when the plurality of clothing items is removed from the interior.

11. The support carrier of claim 9, wherein said connectors comprise one or more of O-rings, D-rings, and swivel clips.

12. The support carrier of claim 9, further comprising a drop-down pocket in the interior of the container body at one end.

13. The support carrier of claim 9, further wherein:

in a third configuration the container body with clothing inserted is adapted to be partially or wholly wrapped around a user's waist or lower back; and in a fourth configuration the container is adapted to be attached to a piece of luggage as an over-the-shoulder carrying strap.

14. A method of using a support carrier for travel, comprising the steps of:

providing an elongated, flexible tubular container body with a longitudinal axis, a flexible spine, a top, a bottom, and two ends, each end comprising an opening allowing access to an interior of said container body and a flexible end cover adapted to close and open said opening by zippered attachment to the respective end, wherein the top of the container body is longer than the bottom of the container body so the zippered attachment at each end is oriented at an acute angle with respect to the longitudinal axis, further wherein said flexible spine is attached to and extends along the top of the container body, said flexible spine further comprising two ends, each end comprising a connector;

placing the container body in a flat and linear first configuration;

opening at least one end of the container body by unzipping the respective zipper;

inserting one or more clothing items into the interior of said container through the opening;

closing the at least one end of the container body by zipping the zipper;

arranging the container body into a second configuration wholly or partially around a user's neck in a horseshoe shape, wherein the one or more clothing items provide support for the neck or head or both.

15. The method of claim 14, further comprising the steps of:

removing said one or more clothing items from said container body; and collapsing said container body.

16. The method of claim 14, further comprising the step of attaching the two ends of the container body together.

17. The method of claim 14, wherein the step of arranging the container body wholly or partially around a user's neck comprises the step of adjusting the clothing items in the container body to fit the user's neck size.

* * * * *